United States Patent [19]

Green

[11] 4,036,439

[45] July 19, 1977

[54] SPRAY HEAD FOR NEBULIZATION OF FLUIDS

[75] Inventor: Elward Howard Green, Addison, Ill.

[73] Assignee: Newman-Green, Inc., Addison, Ill.

[21] Appl. No.: 616,406

[22] Filed: Sept. 24, 1975

[51] Int. Cl.[2] ..... B05B 1/30

[52] U.S. Cl. ..... 239/466; 239/493

[58] Field of Search ..... 239/490–497, 239/466, 468, 467, 470

[56] References Cited

U.S. PATENT DOCUMENTS

| | | | |
|---|---|---|---|
| 1,390,048 | 9/1921 | Lange | 239/470 |
| 3,129,893 | 4/1964 | Green | 239/490 |
| 3,226,040 | 12/1965 | Briechle et al. | 239/492 X |
| 3,519,210 | 7/1970 | DuPlain | 239/492 |
| 3,570,770 | 3/1971 | Ewald | 239/470 X |
| 3,652,018 | 3/1972 | Focht | 239/490 |

FOREIGN PATENT DOCUMENTS

| | | | |
|---|---|---|---|
| 237,372 | 12/1964 | Austria | 239/468 |
| 1,161,865 | 8/1969 | United Kingdom | 239/492 |

*Primary Examiner*—John J. Love

[57] ABSTRACT

A spray head for the nebulization of fluid under pressure having a swirl chamber with a discharge orifice and a pair of passages operative to conduct fluid to said chamber, the chamber including two wall portions symetrically interposed between the passages and the discharge orifice, the configuration and disposition of said wall wall portions cooperatively to produce a swirling of fluid about the discharge orifice and effect nebulization of discharging fluid over a wide range of fluid pressures.

12 Claims, 9 Drawing Figures

FIG. 5
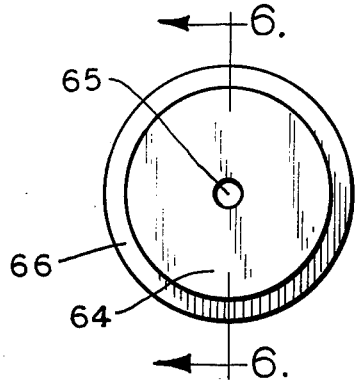
FIG. 6
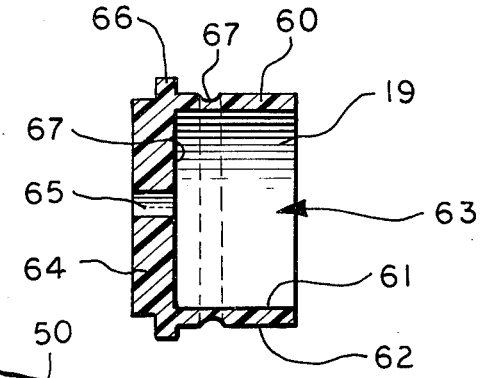
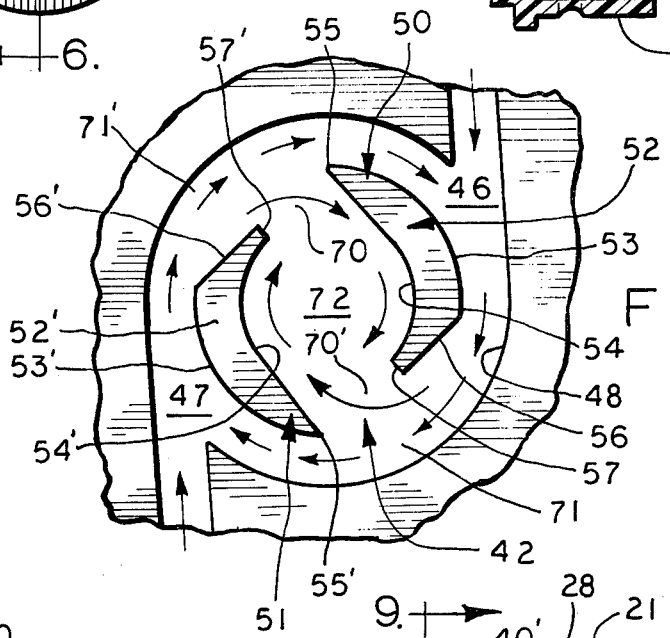
FIG. 8
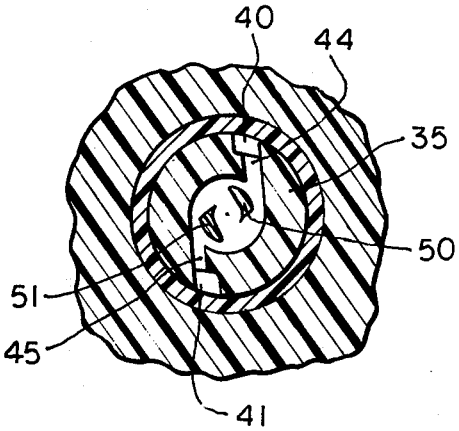
FIG. 9
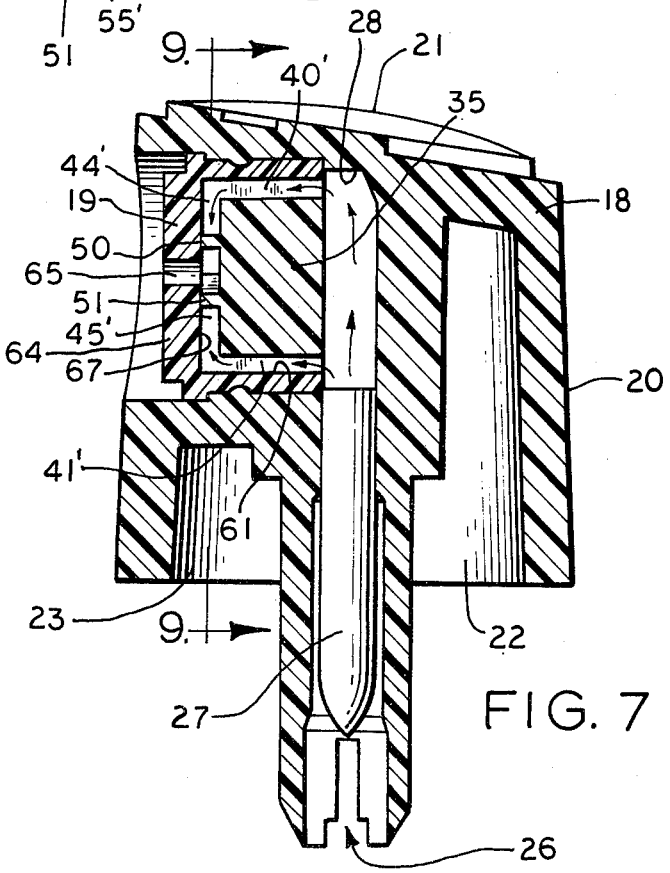
FIG. 7

SPRAY HEAD FOR NEBULIZATION OF FLUIDS

BACKGROUND OF THE INVENTION

Generally this invention relates to a spray head for use with pressurized containers commonly referred to as pressurized dispensers. More particularly, this invention relates to that portion of the spray head which is operative to mechanically breakup and nebulized to reduce to a fine spray that fluid emerging from the discharge orifice.

Recent interests in ecology have directed attention away from using hydrocarbon or freon compounds as propellants for dispersing consumer oriented products. Compressed gases such as carbon dioxide, nitrogen, or the like are desirable as a propellant medium because of their non-polluting effect on the environment. However, it has been found that certain problems are created by employing a purely gaseous medium as a propellant. The propellant gas, necessarily, is initially placed under relatively high pressures within the container to assure an ample supply of propellant to exhaust the product therewithin. Such pressures may range from 80 to 110 psi. Because of the high initial pressures the discharge orifice is maintained in the range of 0.010 inches in diameter. As the product within the container is discharged the pressure of the propellant continually drops such that the internal pressure is in the range of 40 psi or lower at the time the product is exhausted. Spray heads at this time due to the wide range of pressure variances together with a fixed diameter orifice dimension have resulted in undesirable particle dispersion and pattern over the life of the dispenser. For when the dispenser is first used and pressures are high present spray head design will produce satisfactory nebulization characteristics of the fluid product as it emerges from the orifice, however, as pressure drops these characteristics are acutely affected to such an extent that remaining product pressurized at lower pressures is not effectively broken-up resulting in emergence as large droplets or even a stream.

A general object of the invention is to provide a spray head which will have satisfactory nebulization characteristics over a wide range of fluid product pressures.

Another object of the invention is to provide a spray head having a swirl chamber for use with a container pressured with a purely gaseous medium as a propellant which enables nebulization of fluid, over expected pressure ranges of the propellant.

A still further object of the foregoing is to provide two passages for the conduction of fluid to the swirl chamber, and the swirl chamber having two wall portions symetrically disposed between said passage and a discharge orifice.

A still further object of the invention is to provide that the spray head is constructed of a button portion having a swirl cavity with the wall portions and passages integral therewith, and an enclosing insert having the discharge orifice on said button portion to form the swirl chamber.

Novel features of construction and operation of the device will be more clearly apparent during the course of the following description, reference being had to the accompanying drawings wherein has been illustrated a preferred form of the device and wherein like characters of reference are employed to denote like parts throughout the several figures.

DESCRIPTION OF THE DRAWINGS

FIG. 5 is a front elevational view of the enclosing insert;

FIG. 6 is a sectional view of the insert taken substantially along line 6—6 of FIG. 5 as indicated;

FIG. 7 is a somewhat enlarged sectional view of the spray head as shown in FIG. 3 with the enclosing insert shown in place;

FIG. 8 is an enlarged fragmentary front elevational view of the spray head showing the swirl cavity; and FIG. 9 is a sectional view taken substantially along line 9—9 of FIG. 7 as indicated.

DESCRIPTION OF THE PREFERRED EMBODIMENT

Figure 1:
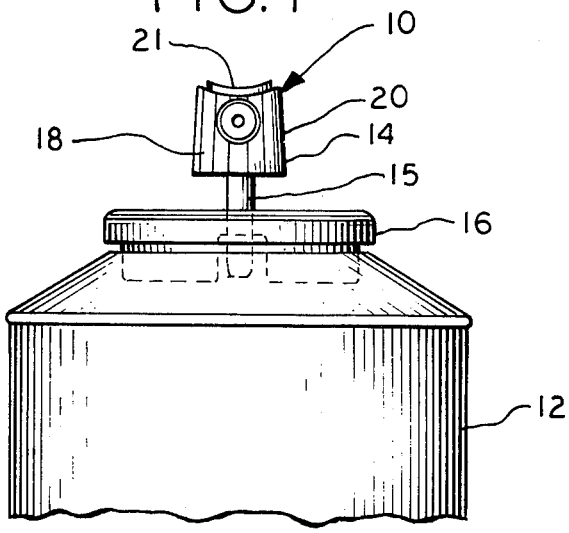
FIG. 1 is a front elevational view of the spray head operatively mounted on a container partially shown.

Turning attention to FIG. 1, the spray head, generally designated 10, is shown in assembled relation to a container 12 which would contain a fluid or fluent mixture under pressure for dispensing by the spray head.

The spray head 10 comprises a push-button body member 14 having a centrally located depending stem 15. It can be seen that the stem 15, upon assembly with the container 12, is disposed on a cover member 16 thereof. The spray head 12 is mounted on a valve structure (not shown) which is carried within the pressurized container. This valve structure receives the stem 15 and sealingly engages therewith. Upon the push button body member is depressed in the direction as indicated by arrow "A" in FIG. 1 the valve will actuate allowing pressurized fluid contents of the container 12 to the spray head 10 for dispensing as will be explained below. The valve structures employed in such containers are well known to those skilled in the art, and is not essential in the description of the instant invention.

The push button body member 14 comprises a body portion 18 and an enclosing insert 19, which is shown in FIGS. 5 and 6.

Figure 4:
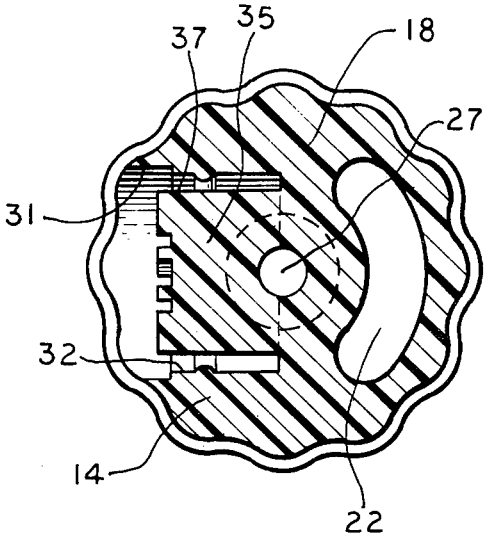
FIG. 4 is a sectional view of the entire spray head shown in FIG. 2 taken substantially along the line 4—4 of FIG. 3 as indicated.
Figure 2:
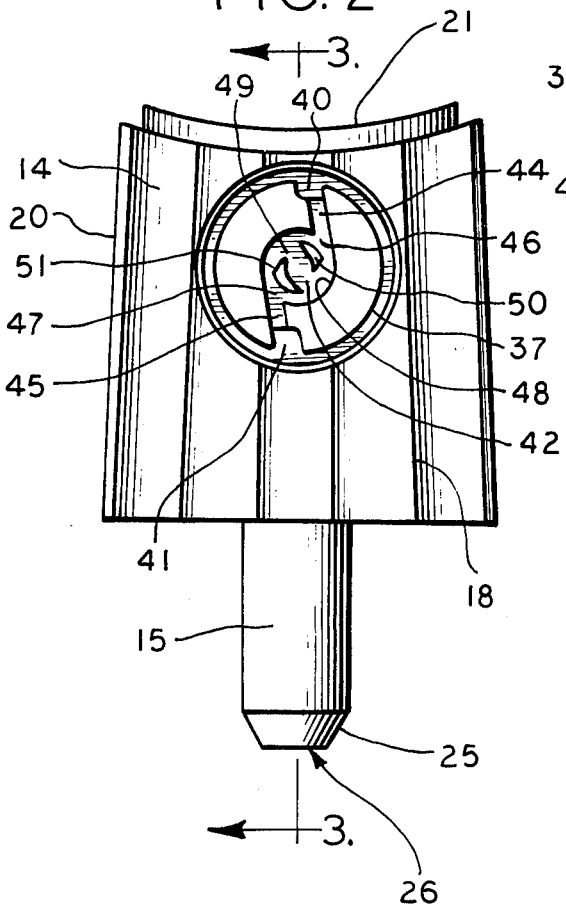
FIG. 2 is an enlarged elevational view of the spray head with the enclosing insert removed.
Figure 3:
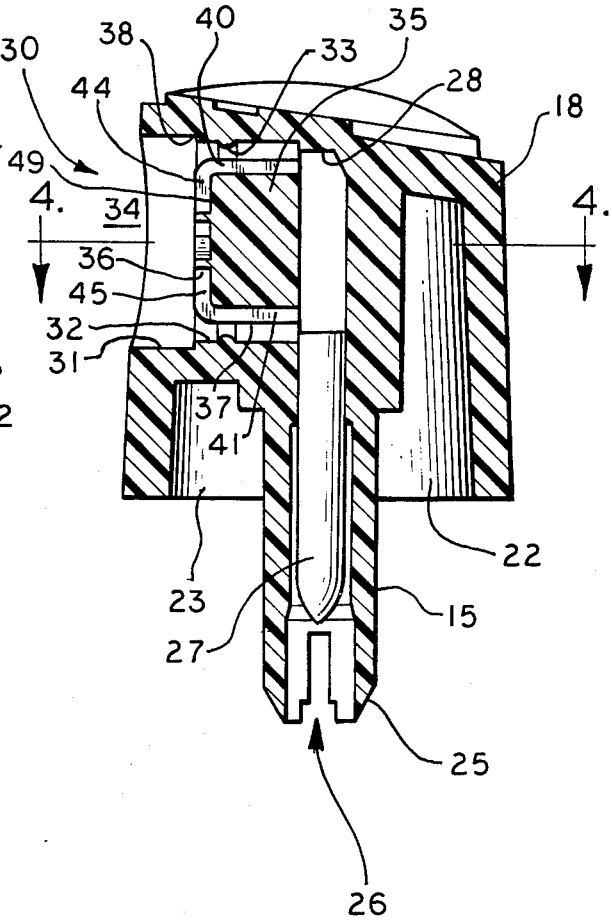
FIG. 3 is a sectional view of the spray head taken substantially along the line 3—3 of FIG. 2 as indicated.

As best seen in FIGS. 2 and 3 the body portion 18 comprises an outer side wall 20 and concave top wall 21. The body portion 18 may also have voids 22 and 23 to lighten and economize on the amount of material required to construct the same, however, the voids are not essential to the invention as herein described. The depending stem 15 has a conically-shaped end portion 25 which circumscribes and opening 26. This opening 26 communicates with a cylindrically shape duct 27 which partially extends through the body portion 18 in substantial central disposition as shown in FIGS. 3 and 4. The duct 27 terminates at an end 28 adjacent the top wall 21.

At the upper end of the body portion 18 there is a cylindrically shaped opening 30 through the side wall 20. This opening 30 is disposed angularly in substantial perpendicular relation to the duct 27. The opening 30 defines an outer annular side wall 31 which extends inwardly of the body portion 18 to another inner annular side wall 32 having a diametrical dimension slightly less than that of side wall 31, thereby forming an annular surface 38. Annular side wall 31 and 32 are disposed in substantial concentric relation with one another. The inner wall 31 also includes a small annular bead 33 thereabout the purpose of which will be explained.

As can be seen the annular walls 31 and 32 form a cylndrically shape cavity 34. Centrally disposed in the cavity 34 in coaxial disposition with the annular walls 31 and 32 is formed a cylindrically shaped projection 35 extending outwardly from the duct 27 and terminating in a flat circular face 36. The face 36 is disposed substantially normal to the common axis of annular side walls 31 and 32. The projection 35 defines an encompassing side wall 37. The projection 35 includes upper and lower grooves designated 40 and 41 respectively formed in the side wall 37. Each of the grooves 40, 41 disposed in the projection 35 are positioned radially thereto in substantial alignment with the duct 27 and at the inner ends thereof each communicated with the duct. Each of the groove 40, 41 extend outwardly to the face 36. The face 36 of the projection 35 has formed therein a cylindrically shape swirl cavity 42 being disposed in the center of the projection in substantial concentric disposition with the inner and outer side walls 31 and 32. The face 36 also includes top and bottom channels 44 and 45, respectively each having a cross sectional dimension smaller than that of the upper and lower groove 41, 42 with which they respectively join.

As best seen in FIGS. 2, 3, and 9 the channels 44, 45 are slantingly disposed along the face 36 such that they enter the swirl cavity thereby each defining entrances designated 46 and 47 respectively.

The swirl cavity 42 defines an encompassing side wall 48 which is interrupted at the entrances 46, 47, the depth of the cavity 42 and therefore the height of the side wall 42 thereof or substantially of the same dimension. Within the cavity 42 there is formed a base wall 49 which has a substantially circular shape and is disposed in substantial parallel disposition with the face 36 of the projection 35. Extending outwardly from the base wall 49 and integral with the projection 35 are a pair of substantially identically shaped wall portions or baffle elements designated 50 and 51 respectively. Each of the wall portions 50, 51 terminate in a flat outer surface 52, 52'. It is pointed out at this time that since the wall portions 50, 51 are substantially identical in form the same numerals will be assigned to the various parts thereof and will be differentiated only by a prime symbol.

Each wall portion or baffle elements 50, 51 comprises an outer and inner arcuate wall face or surface 53, 53' and 54, 54', respectively. Walls 53, 54 and 53', 54' join at one end to form an edge 55, 55'. The outer end of outer wall 53, 53' merge with a flat wall face or surface 56, 56' which extends to join inner wall 54, 54' at a flattened edge face or surface 57, 57'. All of the walls and edges of each of the wall portions 50, 51 are substantially parellel to side wall face or surface 48 of the cavity 42. Also the outer surfaces 52, 52' are disposed substantially parallel to the circular face 36 and the height dimension of each wall portion 50, 51 is substantially the same dimension as the height of the encompassing side wall 48 of the cavity. FIG. 8 best illustrates these wall portions.

As stated before the push button body member 14 also includes the enclosing insert 19. This insert is shown singularly in FIGS. 5 and 6. The insert has a cup-shaped configuration and has a cylindrical side wall section 60 defining inner and outer surfaces 61 and 62 respectively. The internal diametrical dimension of section 60 is slightly smaller than the outer diametrical dimension of projection 35. Also the outside diametrical dimension of section 60 is slightly larger than the diameter of annular side wall 32. One end of section 60 terminates in an opening 63. The other end of section 60 merges with an endorsing end wall 64 having an inner surface 67. Wall 64 includes a discharge orifice 65 centrally disposed in axial alignment with wall section 60. End wall 64 includes an annular encompassing rib 66. Furthermore, an annular groove 67 is disposed about section 60 in the outer surface 62. This rib is disposed in spaced relation to the rib 66, so upon assembly the groove 67 mates with the annular bead 33 just as the rib 66 engages the annular surface 38 of the push button body portion 18. This locks insert 19 in place.

FIG. 7 shows the body portion 18 and enclosing insert 19 assembled to form the push button body member 14. It can be appreciated that upon assembly the insert 19 is pressed into the opening 30. Since it is contemplated that body portion 18 and the insert 19 are to be made of plastic material, cold flow of such material will provide a tight seal of the section 60 with the projection 35 as well as the inner wall 32 of body portion 18. It can be seen in FIG. 7 the wall section 60 extends along the entire length of projection 35 at the position the insert 17 locks in permanent position. At this point bead 33 and annular groove 67 mate and rib 66 engages surface 38.

Upon the assembly of insert 19, the inner rear surface 67 of end wall 64 thereof sealing engages the circular face 36 and the flat end surfaces 52, 52'.

The result of the insert 19 being assembled with the body portion 18 is the respective formation of passages 40' and 41' from the upper and lower grooves 40, 41 disposed radially in the projection 35. In like manner passages 44', 45' are formed from channels 44, 45 respectively upon inner surface 67 engaging the face 36. Also a swirl chamber 42' is formed by the swirl cavity 42 being covered at the open end thereof by inner surface 67 of the insert 19. It is also pointed out that the orifice 65 will be disposed in the center of the swirl chamber 42' and at the outer end thereof.

Turning attention to FIG. 9, it can be seen that the wall portions 50, 51 are concentrically disposed within the cavity 42. It is also pointed out that each of the wall portions 50, 51 are interposed between entrance 46, 47 respectively and the center of the cavity 42. The entire arcuate portions of the outer walls 53, 53' have the same radius. Those arcuate portions of inner walls 54, 54' have the same radius. Each of the wall portions 50, 51 are arranged symetrically and concentrically within the cavity 42 in spaced relation to each other with the edge of one wall portion disposed in adjacent spaced relation to the flattened edge of the other wall portion such that the wall portions together form a pair of openings 70 and 70' at their respective edges. The disposition of the wall portions also provide outer flow passages 71, 71' and an inner swirl space 72 disposed centrally to the discharge orifice 65. It is also pointed out that because of the arrangement of the wall portions 50, 51, the flattened edges 57, 57' thereof extend away from the flow passage 71, 71' thereby providing an area of flaring or expanded sections of each flow passage thereat. It should be noted that edges 55, 55' extend into this area of flaring and define the downflow termination thereof. It should be also noted that the lower passage 45' is disposed in the lower portion of the swirl chamber 42' to promote draining of the chamber after use.

The push button body member 14 and the insert 19 are preferably molded of plastic to achieve the greatest economy in construction thereof.

With respect to the type of plastics used, care is required to choose a suitable composition which is at least fairly well compatible with the bases and propellants used in the mixture. Swelling and deterioration due to chemical or physical reaction may be insignificant with proper choice of plastics. Many synthetic resins are suitable.

The drawings illustrate the physical components of the instant invention many times actual size. Listed below are several approximate dimensions of the components, such are given by way of example only, and may vary.

| | |
|---|---|
| Diameter of swirl cavity 42 | .075 in. |
| Radius of outer walls 53, 53' | .027 in. |
| Radius of arcuate portion of inner walls 54, 54' | .018 in. |
| Depth of swirl cavity 42 | .012 in. |
| Width of top and bottom channel 44, 45 | .010 in. |
| Diameter of discharge orifice 65 | .006 in. |

In operation upon spray head 10 being manually arcuated to open the valve of the container 12 the fluid is forced under pressure through the duct 27 into the passages 40', 41' which communicate therewith. The fluid then passes through passages 44', 45' and enters the swirl chamber 42 at the respective entrance 46, 47. It can be appreciated that the fluid will have an initial flow direction into the chamber 42 in a tangential relation to the chamber between the side wall 48 and the wall portions 50, 51. It is believed that as the fluid progress into the flared area the flow will enlarge with a portion continuing along the wall 48 and the remaining portion being diverted into the inner swirl space 72 as illustrated by the arrows in FIG. 8. The venture effect at each of the entrances together with space between the wall portions and the side of the swirl chamber provide a metering effect which allows the fluid to effectively swirl about the inner swirl chamber over a large difference of pressures propelling the fluid. The fluid therefore is allowed to swirl within the inner swirl space 72, and about the discharge orifice 65 to provide effective nebulization of the fluid during discharge thereof over a substantial range of fluid pressures changes.

It will be appreciated that the embodiment of the invention chosen for the purposes of illustration and description herein is that preferred based upon requirements for achieving the objects of the invention and developing the utility thereof in the most desirable manner. Due regard being had to existing factors of economy, simplicity of design in construction, production methods and improvements sought to be effected. It will be understood, that the particular structure and functional aspect emphasized herein are not intended to exclude but rather to suggest other modifications and adaptations as fall within the spirit and scope of the invention as defined in the appended claims.

What is claimed is:

1. A spray head having means including a duct for dispensing nebulized fluid from a pressurized container comprising;

a body member having a projection terminating at an outer face and having at least two passages communicating with said duct and extending to said outer face;

baffle elements disposed on said projection extending axially outwardly of said face;

an insert mounted in said body member having a peripheral wall extending into a bore in said body member radially outwardly of said passages and having a radial wall comprising a rear face opposing said baffle elements and forming therewith and with said peripheral wall inner and outer generally concentric swirl chambers, said passages having outlet end portions tangential to said outer chamber providing inlets communicating therewith;

said baffle elements each having an arcuate contour and having a leading end portion including means directed into the direction of swirling moment of the fluid stream for splitting the stream to cause a part thereof to continue in the outer chamber and divert a part thereof to churn in the inner chamber;

each baffle element having a trailing portion in respect to the direction of movement of the fluid in said chambers comprising a surface diverging toward the splitting means of the adjacent baffle element and;

said insert having a discharge orifice in the radial wall thereof communicating with said inner chamber.

2. The invention according to claim 1 and said baffle elements having flat outer surfaces in flat face engagement with the rear face of the insert.

3. The invention according to claim 2 and said baffle elements being disposed athwart said respective inlets.

4. The invention according to claim 3 wherein said projection has a base wall and said rear face of said insert are spaced axially and generally paralled with each other.

5. The invention according to claim 1 wherein said trailing portion of each baffle element defines an expanded section of said outer chamber to permit flow of said fluid toward the leading end portion of the element immediately downstream of the respective trailing portion to effect impingement of fluid thereagainst.

6. The invention according to claim 3 and said inlets are spaced 180° apart.

7. The invention according to claim 5 and said expanded sections are spaced intermediate said inlet passages.

8. The invention according to claim 5 and said baffle elements being generally crescent shaped.

9. The invention according to claim 5 and said expanded sections being offset circumferentially with respect to said inlets.

10. The invention according to claim 5 wherein the arcuate contour of said baffle elements are disposed substantially tangentially to said respective inlets.

11. The invention according to claim 5 wherein said baffle elements and said inlets are two in number and said expanded sections of said outer swirl chamber are offset approximately 90° from inlet and are spaced 180° from each other.

12. The invention according to claim 5 wherein said splitting means includes each leading end portion having a sharp-pointed leading end disposed immediately downstream of said respective expanded sections of said outer swirl chamber.

* * * * *